US005612295A

United States Patent [19]

Bell et al.

[11] Patent Number: 5,612,295

[45] Date of Patent: Mar. 18, 1997

[54] LUBRICANT ADDITIVE COMPOSITIONS

[75] Inventors: Donald R. Bell, Collinsville, Ill.; Rolfe J. Hartley, Glen Allen, Va.; Andrew G. Papay, Manchester, Mo.

[73] Assignee: Ethyl Corporation, Richmond, Va.

[21] Appl. No.: 624,865

[22] Filed: Mar. 27, 1996

Related U.S. Application Data

[63] Continuation-in-part of Ser. No. 245,600, May 18, 1994, abandoned.

[51] Int. Cl.[6] ..... C10M 133/00

[52] U.S. Cl. ..... 508/188; 508/192; 564/8; 564/15

[58] Field of Search ..... 508/188, 189, 508/190, 192; 564/8, 15

[56] References Cited

U.S. PATENT DOCUMENTS

| | | | |
|---|---|---|---|
| 4,428,849 | 1/1984 | Wisotsky | 508/242 |
| 4,925,983 | 5/1990 | Steckel | 508/192 |
| 5,089,156 | 2/1992 | Chrisope et al. | 508/192 |
| 5,130,036 | 7/1992 | Burt et al. | 508/428 |
| 5,505,868 | 4/1996 | Ryan et al. | 508/188 |

FOREIGN PATENT DOCUMENTS 2257158 1/1993 United Kingdom .

*Primary Examiner*—Prince Willis, Jr.
*Assistant Examiner*—Cephia D. Toomer
*Attorney, Agent, or Firm*—Dennis H. Rainear

[57] ABSTRACT

Multifunctional additives having a variety of advantageous properties are described. They are formed by a process which comprises heating concurrently or in any sequence a) an oil-soluble ashless dispersant containing basic nitrogen with b) an alkoxylated alcohol of at least 8 carbon atoms c) a borating agent and optionally d) an inorganic oxyacid or anhydride of phosphorous. The reactants are in proportions on an active ingredient basis of about 0.03 to about 0.35 part by weight of b) per part by weight of a), and about 0.005 to about 0.06 part by weight of boron as c) per part by weight of a). The reaction temperature can range from about 50° to about 150° C. Water and/or solids present in the resultant mixture can be removed. Preferably, the optional phosphorous component is used in the formation of these additives. This phosphorous component can be an inorganic oxyacid or anhydride of phosphorous.

22 Claims, No Drawings

LUBRICANT ADDITIVE COMPOSITIONS

RELATED APPLICATIONS

This application is a continuation-in-part of patent application Ser. No. 08/245,600 filed on May 18, 1994, now abandoned.

TECHNICAL FIELD

This invention relates to novel metal-free boron-containing compositions that are useful as multifunctional additives in oils of lubricating viscosity. In addition, this invention relates to novel metal-free boron- and phosphorous-containing compositions that are useful as multifunctional additives in oils of lubricating viscosity.

BACKGROUND

Heretofore the formation of borated ashless dispersants has been reported. Typical disclosures on this subject include U.S. Pat. Nos. 3,087,936; 3,254,025; 3,281,428; 3,282,955; 3,284,409; 3,284,410; 3,338,832; 3,344,069; 3,533,945; 3,658,836; 3,703,536; 3,718,663; 4,455,243; and 4,652,387.

U.S. Pat. No. 4,857,214 describes oil-soluble lubricant additive compositions formed by heating an inorganic phosphorous acid or anhydride, including partial and total sulfur analogs thereof, a boron compound, and an ashless dispersant which contains basic nitrogen and/or a hydroxyl group. Such additives have excellent antiwear/EP properties and impart antioxidancy to lubricating oils including functional fluids such as automatic transmission fluids. In addition, such additives exhibit improved rubber seal protective properties.

U.S. Pat. Nos. 5,256,324 and 5,164,103 disclose a preconditioned automatic transmission fluid made by using a preblend formed by heating an alkenyl succinimide or succinamide dispersant with a phosphorous ester and water to partially hydrolyze the ester and then mixing the preblend and other additives with a base oil. This patent does not suggest or disclose a multifunctional gear additive composition formed by heating an oil-soluble ashless dispersant containing basic nitrogen with an alkoxylated alcohol and a borating agent.

U.K. patent application 2,257,158 discloses an automatic transmission fluid or fluid for wet brake systems that includes an additive which increases the dynamic and/or static coefficients of friction. The additive as claimed is made by heating an ashless dispersant containing basic nitrogen with an inorganic acid of phosphorous, a boron compound and a polyol having up to 8 carbon atoms. This application teaches away from the present invention since it intends to increase friction in the transmission fluid while the present invention discloses an additive that reduces friction through the use of an alkoxylated alcohol that has at least 8 carbon atoms.

U.S. Pat. No. 4,876,020 discloses a lubricating oil composition that contains one or more overbased alkaline earth metal salts of an aromatic carboxylic acid which improves the detergent properties of the oil and an effective amount of a polyalkoxylated alcohol having a molecular weight of from 150 to 1500. This patent does not suggest the reaction of an alkoxylated alcohol having at least 8 carbon atoms with an oil soluble ashless dispersant containing basic nitrogen, a borating agent and an inorganic oxyacid or anhydride of phosphorous.

U.S. Pat. No. 5,089,156 discloses an ashless or low-ash oleaginous liquid composition comprising a major mount of hydrogenated poly-α-olefin oligomer fluid having a viscosity in the range of about 2 to about 10 cSt at 100° C., and minor amounts of hydrogenated poly-α olefin oligomer and an antiwear/extreme pressure agent selected from phosphorous-containing ashless dispersant, boron-containing ashless dispersant, and phosphorous- and boron-containing ashless dispersants.

THE INVENTION

Novel and eminently useful multifunctional additives are provided by this invention. One embodiment of this invention provides multifunctional additive compositions formed by a process which comprises heating concurrently or in any sequence a) an oil-soluble ashless dispersant containing basic nitrogen with b) an alkoxylated alcohol of at least 8 carbon atoms and c) a borating agent to a temperature in the range of about 50° to about 150° C., and if water and/or solids are present in the resultant mixture, removing both of them or whichever of them is present in the resultant mixture. These novel multifunctional additives once prepared and filtered are clear mixtures that tend to remain free of haze and solids even after long periods of storage at elevated temperatures such as 70° C., even though they may contain high levels of boron within the range of proportions described hereinafter.

Another embodiment provides multi functional additives which are formed by heating concurrently or in any sequence a) an oil soluble ashless dispersant containing basic nitrogen with b) an alkoxylated alcohol of at least 8 carbon atoms, c) a borating agent and d) an inorganic oxyacid or anhydride of phosphorous to a temperature in the range of about 50° to 150° C., and if water and/or solids are present in the resultant mixture, removing both of them or whichever of them is present in the resultant mixture. These novel additives possess the above storage stability properties as well as all of the advantageous properties of the additives described in U.S. Pat. No. 4,857,214. Indeed these additives can contain a high loading of both boron and phosphorous within the proportion ranges set forth hereinafter and remain stable for long periods of time at elevated temperatures without incompatibility problems being encountered. In addition, the multifunctional additives of the present invention exhibit improved performance in the Mitsubishi Water Test or the ASTM D 2711 demulsibility test as compared to a corresponding additive made in the same way with the same amount of the same materials except for the elimination of the alkoxylated alcohol.

More specifically, this invention relates to a multifunctional gear additive composition formed by a process which comprises heating concurrently or in any sequence a) an oil-soluble ashless dispersant containing basic nitrogen with b) an alkoxylated alcohol of at least 8 carbon atoms and c) a borating agent in proportions on an active ingredient basis of about 0.03 to about 0.35 part by weight of b) per part by weight of a), and about 0.005 to about 0.06 part by weight of boron as c) per part by weight of a) to a temperature in the range of about 50° to about 150° C., and if water and/or solids are present in the resultant mixture, removing both of them or whichever of them is present in the resultant mixture.

This invention also relates to a multifunctional gear additive composition formed by a process which comprises heating concurrently or in any sequence a) an oil soluble ashless dispersant containing basic nitrogen with b) an alkoxylated alcohol having from 8 to 16 carbon atoms c) a borating agent and d) an inorganic oxyacid or anhydride of phosphorous in proportions on an active ingredient basis of about 0.03 to about 0.35 part by weight of b) per part by weight of a), about 0.005 to about 0.06 part by weight of boron as c) per part by weight of a), and about 0.005 to about 0.03 part by weight of phosphorous as d) per part by weight of a), to a temperature in the range of about 50° to 150° C., and if water and/or solids are present in the resultant mixture, removing both of them or whichever of them is present in the resultant mixture.

In a specific embodiment of this invention, the additive compositions are multifunctional gear additives produced using an ethoxylated $C_8$–$C_{16}$ alcohol having an average of 1 to 3 ethoxy groups per molecule. Additives according to this invention are effective as antiwear/extreme pressure additives and, additionally, contribute rust inhibition properties to gear oils. Moreover, among other desirable properties, the additives of this invention possess good demulsibility properties, have good thermal and oxidative stability, can be stored for long periods of time without haze or sediment formation, and improve the copper corrosion resistance of formulated gear oils.

There is also disclosed a process to prepare the multifunctional gear additive composition according to this invention, which comprises heating concurrently or in any sequence a) an oil soluble ashless dispersant containing basic nitrogen selected from the group consisting of polybutenyl succinimide ashless dispersants with b) an alkoxylated alcohol selected from the group consisting of ethoxylated alcohols of 8 to 16 carbon atoms, c) a borating agent and d) an inorganic oxyacid or anhydride of phosphorous at a temperature of at least 100° C. for at least one hour and thereafter filtering and drying the composition.

Lubricating oil compositions which comprise from 0.1 to 99.9 parts by weight of any of the above additive compositions and from 99.9 to 0.1 parts by weight of at least one oil of lubricating viscosity are additional embodiments of this invention. Another embodiment is lubricating oil compositions which comprise from 0.1 to 50 parts by weight of any of the above additive compositions and from 50 to 0.1 parts by weight of at least one oil of lubricating viscosity.

Other embodiments and features of this invention will become still further apparent from the ensuing description and appended claims.

Component a)—Oil Soluble Ashless Dispersant

Basic nitrogen-containing ashless dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight alphatic or alicyclic halides with amines, such as polyalkylene polyamines. Mixtures of such dispersants can also be used.

Such basic nitrogen-containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos. 3,018,247; 3,018,250; 3,018,291; 3,172,892; 3,185,704; 3,219,666; 3,272,746; 3,361,673; and 4,234,435. Mixed ester-amides of hydrocarbyl-substituted succinic acid are described, for example, in U.S. Pat. Nos. 3,576,743; 4,234,435 and 4,873,009. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. Nos. 3,275,554; 3,438,757; 3,454,555; and 3,565,804.

The ashless dispersant treated in accordance with this invention is preferably a hydrocarbyl succinimide, a hydrocarbyl succinic ester-amide or a Mannich base of a polyamine, formaldehyde and a hydrocarbyl phenol in which the hydrocarbyl substituent is a hydrogenated or unhydrogenated polyolefin group and preferably a polypropylene or polyisobutene group having a number average molecular weight (as measured by gel permeation chromatography) of from 250 to 10,000, and more preferably from 500 to 5,000, and most preferably from 750 to 2,500. The ashless dispersant is most preferably an alkenyl succinimide such as is available commercially from Ethyl Petroleum Additives, Inc. and Ethyl Petroleum Additives, Ltd. as HiTec® 644 and HiTec® 646 additives and especially as HiTec® 634 additive. Most preferred is the polybutenyl succinimide ashless dispersant sold by Ethyl Corporation as HiTec® 633. Other suitable commercially available alkenyl succinimides which may be used in the practice of this invention include for example Anglamol 890, 894, 935, 6406, 6418 and 6420 from The Lubrizol Corporation, ECA 4360, 5017, and 5025 from Exxon Chemicals, and OLOA 373,374 and 1200 from Chevron Chemical Company.

In general amines containing basic nitrogen or basic nitrogen and additionally one or more hydroxyl groups, including amines of the types described in U.S. Pat. No. 4,235,435 can be used in the formation of the ashless dispersants. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine, and dipropylene triamine. While pure polyethylene polyamines can be used, it is generally preferred to use mixtures of linear, branched and cyclic polyethylene polyamines having an average in the range of about 2.5 to about 7.5 nitrogen atoms per molecule and more preferably an average in the range of about 3 to about 5 nitrogen atoms per molecule. Mixtures of this type are available as articles of commerce. Hydroxy-substituted amines include N-hydroxyalkyl-alkylene polyamines such as N-(2-hydroxyethyl)ethylene diamine, N-(2-hydroxyethyl)piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

Component b)—Alkoxylated Alcohols

Alkoxylated alcohols can be useful in forming the additives of this invention include oil-soluble alkoxylated alkanols, alkoxylated cycloalkanols, alkoxylated 5polyols, alkoxylated phenols, and alkoxylated heterocyclic alcohols which contain an average of up to about 20 alkoxy groups per molecule. The alkoxy groups can be methoxy, ethoxy, propoxy, butoxy, or pentoxy, or combinations of two or more of these. However ethoxy-substituted alcohols are preferred. For best results, the alkoxylated alcohol should be a liquid at ambient temperatures in the range of 20°–25° C. Since the alkoxylated alcohol should be oil-soluble, short chain alcohols preferably contain an average of at least two alkoxy groups per molecule whereas longer chain alcohols may contain one or more alkoxy groups per molecule. The average number of alkoxy groups in any given alcohol can be as high as 15 or 20 as long as the product is oil soluble and is preferably a liquid at room temperature. Examples of alcohols that form suitable alkoxylated alcohols include $C_{1-24}$ alkanols, $C_{1-10}$ cycloalkanols, polyols having up to about 16 carbon atoms and 2–5 hydroxyl groups, polyol ethers having up to about 16 carbon atoms and at least one hydroxyl group, phenol, alkylphenols having up to about 16 carbon atoms, and hydroxy-substituted heterocyclic compounds such as tetrahydrofurfuryl alcohol and tetrahydropyran-2-methanol.

Preferred is an alkoxylated alcohol of 8 to 16 carbon atoms or mixture of two or more of such alcohols having an average of 1 to 10 ethoxy groups per molecule. Particularly preferred is an ethoxylated $C_{12}$ alcohol having an average of 1 to 3 ethoxy groups per molecule.

Component c)—Borating Agent

Suitable boron materials which can be used as borating agents include boron acids, boron oxides, boron esters, ammonium borate, and super-borated dispersants - - - i.e., dispersants such as described above which have been heavily borated. Aminoboranes can be used, but are expensive. Boron halides, while useable, tend to contribute a halogen content to the dispersant or increase the halogen content of the dispersant, neither of which is desirable.

Examples of suitable borating agents include boron acids such as boric acid, boronic acid, tetraboric acid, metaboric acid, pyroboric acid, esters of such acids, such as mono-, di- and tri-organic esters with alcohols having 1 to 20 carbon atoms and/or phenols having 6 to 20 carbon atoms, e.g., methanol, ethanol, isopropyl alcohol, butanols, pentanols, hexanols, cyclopentanol, cyclohexanol, methylcyclohexanol, ethylene glycol, propylene glycol, phenol, cresols, xylenols, and the like, and boron oxides such as boron oxide and boron oxide hydrate. Orthoboric acid is a preferred borating agent for use in the practice of this invention.

Component d)—Phosphorous Acids and Anhydrides

Examples of inorganic phosphorous acids and anhydrides which are useful in forming the preferred products of the invention include phosphorous acid ($H_3PO_3$), pyrophosphorous acid, phosphoric acid, hypophosphoric acid, phosphorous trioxide ($P_2O_3$), phosphorous tetraoxide ($P_2O_4$), and phosphoric anhydride ($P_2O_5$), also known as phosphorous pentoxide. Mixtures of two or more such compounds can be used. Preferred is phosphorous acid ($H_3PO_3$).

Proportions

Components a), b) and c) are typically used in proportions on an active ingredient basis of about 0.03 to about 0.35 part by weight of b)per part by weight of a), and about 0.005 to about 0.06 part by weight of boron as c) per part by weight of a). Preferably, these proportions on the same basis are from about 0.08 to about 0.30 part by weight of b) and about 0.01 to about 0.05 part by weight of boron as c) per part by weight of a). More preferred proportions are from about 0.12 to about 0.25 part by weight of b) and about 0.012 to about 0.025 part by weight of boron as c) per part by weight of a). Especially preferred proportions are from about 0.15 to about 0.20 part by weight of b) and about 0.015 to about 0.02 part by weight of boron as c) per part by weight of a). When component d) is included in the mixture being heated the proportions are such that on an active ingredient basis there is by weight from about 0.0005 to about 0.03 part, preferably from about 0.001 to about 0.025 part, more preferably from about 0.005 to about 0.02 part, and most preferably from about 0.01 to about 0.02 part, of phosphorous as d) per part by weight of component a). By "on an active ingredient basis" is meant that the weight of any solvent or diluent used with any component is excluded from the calculation of proportions.

Reaction Conditions

As noted above, in one of its forms, this invention involves heating a basic nitrogen-containing ashless dispersant with components b) and c) above, or with components b), c) and d) above to produce a clear homogeneous additive composition. After charging component a), the other components being used can be heated separately with the reactor contents and in so doing, the other components - - - i.e., components b) and c) or components b), c) and d) - - - can be charged to the reaction vessel and heated therein in any sequence. When using components b), c) and d), these components may charged and heated in one or more subcombinations in any sequence. Preferably the components being used - - - b) and c) or b), c) and d) - - - are heated concurrently with component a).

The reactor contents are heated, preferably with agitation, at a suitably elevated temperature within the range of 50° to 150° C., preferably about 90° to 110° C., most preferably at about 100° C. The over-all time may vary from about 1 hour or less to about 6 hours or more depending on the temperature. If water is evolved, such as when using boric acid as component c), the water should be removed by distillation at reduced pressure. Any solids that may remain in the resultant mixture are then removed, preferably by filtration to produce a clear, oil-soluble product.

The process can be carried out in the absence of solvent by mixing and heating the reactants. Preferably, however, if an inorganic borating agent such as boric acid is used as component c), water is added to facilitate the initial dissolution of the boron compound. Water formed in the reaction and any added water is then removed by vacuum distillation at temperatures of from 100°–140° C. Preferably, the reaction is carried out in a diluent oil or a solvent such as a mixture of aromatic hydrocarbons.

Optionally, additional sources of basic nitrogen can be included in the ashless dispersant mixture being used in the process so as to provide a molar amount (atomic proportion) of basic nitrogen up to that equal to the molar amount of basic nitrogen contributed by the ashless dispersant. Preferred auxiliary nitrogen compounds are long chain primary, secondary and tertiary alkyl amines containing from 12 to 24 carbon atoms, including their hydroxyalkyl and aminoalkyl derivatives. The long chain alkyl group may optionally contain one or more ether groups. Examples of suitable compounds are oleylamine, N-oleyltrimethylenediamine, N-tallow diethanolamine, N,N-dimethyloleylamine and myristyl-oxypropyl amine.

Other materials normally used in lubricant additives which do not interfere with the reaction may also be added, for example, a benzotriazole, including lower ($C_1$–$C_4$) alkyl-substituted benzotriazoles, which function to protect copper surfaces.

The amount of boron compound(s) preferably employed ranges from 0.001 mole to 1 mole per mole of basic nitrogen in the mixture up to one half of which may be contributed by an auxiliary nitrogen compound. The amount of phosphorous compound(s), when employed, ranges from 0.001 mole to 0.999 mole per mole of basic nitrogen in the mixture which is in excess of the molar amount of boron compound(s) used.

The amount of added water, when used, is not particularly critical as it is removed by distillation when no longer needed for improving solubility of an inorganic borating agent.

Amounts up to about one percent by weight of the mixture are preferred. When used, the amount of diluent generally ranges from 10 to 50 percent by weight of the mixture. When added, the amount of copper protectant generally ranges from 0.5 to 5 percent by weight of the mixture.

The following examples are illustrative of the present invention. Amounts are in parts by weight unless specified otherwise.

EXAMPLE 1

A mixture of 86.61 parts of HiTec® 2605 additive (a Mannich base dispersant; Ethyl Corporation), 10.07 parts of ethoxylated lauryl alcohol (Trycol 5966; Henkel Corporation), 2.61 parts of 70% phosphorous acid, 5.90 parts of boric acid and 0.81 part of tolyltriazole (Cobratec TT-100) is heated with stirring at 110° C. for 2 hours. Then the temperature is increased to 140° C. and a vacuum of 40 mm is applied and the mixture is kept under these conditions for a period of one hour to remove water formed in the process. The product is then filtered. The resultant solids-free liquid additive contains about 0.41% phosphorous and about 1.03% of boron.

EXAMPLE 2

The procedure of Example 1 is repeated except that an equal weight of HiTec® 7100 additive (a succinic ester-amide dispersant; Ethyl Corporation) is used instead of the Mannich base dispersant.

The resultant additive composition has a phosphorous content of about 0.43% and a boron content of about 0.88%.

EXAMPLE 3

The procedure of Example 1 is repeated except that an equal weight of HiTec® 646 additive (a tetraethylene pentamine succinimide dispersant having a polyisobutenyl substituent formed from polyisobutene having an average molecular weight, as determined by gel permeation chromatography, of about 1300; Ethyl Corporation) is used instead of the Mannich base dispersant. The resultant additive composition has a phosphorous content of about 0.44% and a boron content of about 1.04%.

EXAMPLES 4–6

The procedures of Examples 1–3 are repeated except that the phosphorous acid is omitted. The resultant additive compositions contain similar amounts of boron.

EXAMPLE 7

The procedure of Example 3 is repeated except that the succinimide used is a mixture of 30% of mineral oil and 70% of HiTec® 634 additive (a succinimide dispersant formed from a polyisobutenyl succinic anhydride and triethylene tetramine in a mole ratio of about 1.8 moles of the anhydride per mole of triethylene tetramine, and wherein the polyisobutenyl group of the ashless dispersant is derived from polyisobutene having a GPC number average molecular weight in the range of about 850 to about 1000; Ethyl Corporation).

EXAMPLE 8

The procedure of Examples 7 is repeated except that the phosphorous acid is omitted.

EXAMPLE 9

The procedure of Example 7 is repeated using 83.3 parts of the 70% oil solution of the succinimide dispersant, 9.9 parts of the Trycol 5966, 5.8 parts of boric acid, 1.8 parts of phosphorous acid, 0.8 part of TT-100 and 0.7 part of water. Approximately 2.5 parts of water are recovered from the reduced pressure distillation.

EXAMPLES 10–11

Example 9 is repeated substituting in one case Sterox ND (an ethoxylated alkyl phenol; Monsanto Corporation) and in another case Trycol 5940 for the Trycol 5966. Similar storage stable products are obtained.

EXAMPLES 12–14

Example 9 is again repeated using in one case twice the amount of phosphorous acid, in another case without use of the TT-100 and in another case using twice the amount of Trycol 5966. In each case, storage stable additive compositions are formed.

EXAMPLE 15

Example 9 is repeated except that the dispersant is HITEC® 645 additive (a succinimide dispersant formed from a polyisobutenylsuccinic anhydride and triethylene tetraline in a mole ratio of about 1.6 moles of the anhydride per mole of triethylene tetramine, and wherein the polyisobutylene group of the ashless dispersant is derived from polyisobutene having a GPC number average molecular weight in the range of about 850 to about 1000; Ethyl Corporation).

Additives made as in Examples 1–3 are not only effective as antiwear/extreme pressure additives but additionally contribute rust inhibition properties to formulated gear oils and gear oil additive packages. Additives made as in Examples 7 and 9–15 have good demulsibility properties and water compatibility as shown for example by the Mitsubishi Water Test or the ASTM D 2711 demulsibility test. Additives made such as in Example 7 also improve the copper corrosion resistance of formulated gear oils. Moreover, the products of this invention have good thermal and oxidative stability and thus can be stored for long periods of time without haze or sediment formation, even though they contain high proportions of boron alone or high proportions of both boron and phosphorous. Another very desirable characteristic of the additives of this invention is that they do not contain any metal.

The additives of this invention can be utilized in combination with conventional gear oil additive components such as sulfur-containing antiwear agents, phosphorous-containing extreme pressure agents, copper corrosion inhibitors, rust inhibitors, foam inhibitors, oxidation inhibitors, demulsifiers, and the like. These can be used in their conventional concentrations in the finished gear oils.

As used herein the term "oil-soluble" means that the substance under discussion should be sufficiently soluble at 20° C. in the base oil selected for use to reach at least the minimum concentration required to enable the substance to serve its intended function. Preferably the substance will have a substantially greater solubility in the base oil than this. However, the substance need not dissolve in the base oil in all proportions.

COMPARATIVE TESTING

To demonstrate the novel and unobvious nature of this invention compared to the friction enhancing additives of U.K. patent application 2,256,158, samples were produced and evaluated in an automatic transmission model.

The Control additive was produced in accordance with Example 2 in G.B. 2,257,158 using a commercial succinimide ashless dispersant (HiTec® 644 dispersant, Ethyl Corporation), phosphorous acid, boric acid and 1,2-propylene glycol. The inventive product produced in accordance with Example 7 above was made using ethoxylated lauryl alcohol and was the Experimental additive. The Control and Experimental were made into automatic transmission fluid concentrates and then blended into finished automatic transmission fluids using appropriate base oils. The Control (G.B. 2,257,158) and the Experimental (the invention) were present in the concentrate at a level of 3.772 wt. %. The concentrate was present in the final automatic transmission fluid (ATF) at a level of 5.63 wt. %.

To evaluate the performance of the Control and the Experimental in the AFT, the DEXRON® III 3-T40 plate test was run. This is an official test required by General Motors for approval of ATF. The 3-T40 test is well known to those skilled in this area of technology. Results of the tests are set forth in Table I with testing criteria.

TABLE I

3-T40 Plate Test
20,000 Cycles, Pressure 345.0 k PA,
Temperature 139.7° C., Average Energy 15.74 kJ

| Total | Stop Time, (0.45–0.60 s) | | Midpoint Torque, Nm (150–180) | | Maximum Torque, Nm (greater than 150) | |
|---|---|---|---|---|---|---|
| Cycles | Control | Exp. | Control | Exp. | Control | Exp. |
| 900 | 0.543 | 0.653 | 171.50 | 136.90 | 176.70 | 138.50 |
| 3600 | 0.551 | 0.664 | 169.10 | 135.00 | 170.20 | 138.20 |

TABLE I-continued

3-T40 Plate Test
20,000 Cycles, Pressure 345.0 k PA,
Temperature 139.7° C., Average Energy 15.74 kJ

| Total | Stop Time, (0.45–0.60 s) | | Midpoint Torque, Nm (150–180) | | Maximum Torque, Nm (greater than 150) | |
|---|---|---|---|---|---|---|
| Cycles | Control | Exp. | Control | Exp. | Control | Exp. |
| 7200 | 0.545 | 0.657 | 166.40 | 135.50 | 169.40 | 141.50 |
| 10,800 | 0.524 | 0.648 | 176.40 | 136.30 | 179.10 | 142.50 |
| 14,400 | 0.504 | 0.622 | 180.80 | 142.30 | 188.30 | 155.60 |
| 18,000 | 0.502 | 0.615 | 182.90 | 144.40 | 188.90 | 158.50 |
| 20,000 | 0.505 | 0.614 | 178.00 | 144.20 | 191.30 | 160.40 |

A key measure of ATF performance is the level of midpoint dynamic torque. To meet the DEXRON® III requirements, the midpoint dynamic torque must be between 150 and 180 Nm for test cycles between 1,000 and 20,000. In this test, torque is a measure of friction and the higher the torque, the higher the coefficient of friction.

The data clearly demonstrates that an ATF formulated with the additive described in G.B. 2,257,158 is almost always within the prescribed range while the ATF formulated using the additive in accordance with this invention never makes the minimum level of torque. This is favorable since the additives of this invention are not intended to increase friction but rather reduce it.

This data demonstrates the surprising and unexpected results achieved when using an alkoxylated alcohol of at least 8 carbon atoms to prepare the inventive additive. This data also supports the proposition that G.B. 2,257,158 does not render obvious the present application. In general, the lower alcohols (i.e., less than 8 total carbon atoms) increase friction while the higher alcohols (as taught in the present invention) decrease friction.

Yet another unexpected benefit of the additives according to the present invention relates to demulsibility. During normal operations, internal combustion engines subject lubricants to considerable heating and mechanical shear. Dispersant and detergent additives are incorporated into the lubricant formulation, however, these additives can have a stabilizing effect on foams and emulsions that may form under the high shear regime. Emulsions and foams can seriously impair the effective lubrication of an engine.

One aspect of the present invention relates to the use of the additives in accordance with the invention to formulate automotive and industrial gear oils that can be demulsified. As above, for the ATF evaluation, the additive from Example 2 in G.B. 2,257,158 was compared to the additive produced in Example 7 of this application. The evaluations were conducted using the ASTM D2711 test. The Control and Experimental additives were used to formulate Exxon and Pennzoil 80W90 and 85W140 finished gear oil lubricants. The treat rate for the additives was 7.5% by wt. The data is presented in Table II.

TABLE II

| | Demulsibility Test 7.5 wt % of Additive ASTM D-2711 | | | | | | | |
|---|---|---|---|---|---|---|---|---|
| | Exxon 80W90 | | Pennzoil 80W90 | | Exxon 85W140 | | Pennzoil 85W140 | |
| BASE OIL | Control | Exp. | Control | Exp. | Control | Exp. | Control | Exp. |
| Total Free Water, ml | 84.4 | 84.2 | 77.6 | 86.5 | 69.5 | 80.1 | 59.5 | 81.85 |
| % Water in Oil | 0.9 | 0 | 2.4 | 0 | 0.6 | 0.1 | 7.5 | 0.1 |
| Total Emulsion, ml | 2 | 0.15 | 3.5 | 0.1 | 20 | 0.2 | 10 | 0.3 |
| Result* | fail | pass | fail | pass | fail | pass | fail | pass |

*Passing Limits - Total Free Water, ml-80; % Water in Oil -2; Total Emulsion, ml-2.

The data in Table II demonstrates that the additives made with an alkoxylated alcohol of less than 8 carbon atoms (Control) all failed the test. In contrast, the additives made according to this invention passed in all base oils. Since demulsibility is difficult across base oil types and viscosity grades, this demonstrates the outstanding performance of the additive made in accordance with the present invention.

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

Each and every U.S. patent document referred to hereinabove is fully incorporated herein by reference.

We claim:

1. An additive composition formed by a process which comprises heating concurrently or in any sequence a) an oil-soluble ashless dispersant containing basic nitrogen with b) an alkoxylated alcohol of at least 8 carbon atoms and c) a borating agent to a temperature in the range of about 50° to about 150° C., and if water and/or solids are present in the resultant mixture, removing both of them or whichever of them is present in the resultant mixture.

2. A composition in accordance with claim 1 wherein the ashless dispersant is a succinimide ashless dispersant.

3. A composition in accordance with claim 1 wherein the ashless dispersant is a polyisobutenyl succinimide ashless dispersant formed from a polyisobutenyl succinic acylating agent and triethylene tetramine in a mole ratio of less than 2.0 but more than 1.3 moles of said acylating agent per mole of triethylene tetramine.

4. A composition in accordance with claim 3 wherein the polyisobutenyl group of said ashless dispersant is derived from polyisobutene having an average molecular weight in the range of about 750 to about 2500.

5. A composition in accordance with claim 1 wherein the ashless dispersant is a polyisobutenyl succinimide ashless dispersant formed from a polyisobutenyl succinic anhydride and triethylene tetramine in a mole ratio of about 1.8 moles of said anhydride per mole of triethylene tetramine, and wherein the polyisobutenyl group of said ashless dispersant is derived from polyisobutene having an average molecular weight as determined by gel permeation chromatography in the range of about 500 to about 5000.

6. A composition in accordance with claim 1 wherein said borating agent is a boron acid.

7. A composition in accordance with claim 1 wherein said alkoxylated alcohol is an ethoxylated alcohol of 8 to 16 carbon atoms.

8. An additive composition formed by a process which comprises heating concurrently or in any sequence a) an oil-soluble ashless dispersant containing basic nitrogen with b) an alkoxylated alcohol of at least 8 carbon atoms, c) a borating agent and d) an inorganic oxyacid or anhydride of phosphorous to a temperature in the range of about 50° to about 150° C., and if water and/or solids are present in the resultant mixture, removing both of them or whichever of them is present in the resultant mixture.

9. A composition in accordance with claim 8 wherein said ashless dispersant is a succinimide ashless dispersant.

10. A composition in accordance with claim 8 wherein the proportions on an active ingredient basis are about 0.03 to about 0.35 part by weight of b) per part by weight of a), about 0.005 to about 0.6 part by weight of boron as c) per part by weight of a), and about 0.0005 to about 0.03 part by weight of phosphorous as d) per part by weight of a).

11. A composition in accordance with claim 8 wherein the ashless dispersant is a polyisobutenyl succinimide ashless dispersant formed from a polyisobutenyl succinic acylating agent and triethylene tetramine in a mole ratio of less than 2.0 but more than 1.3 moles of said acylating agent per mole of triethylene tetramine.

12. A composition in accordance with claim 11 wherein the polyisobutenyl group of said ashless dispersant is derived from polyisobutene having an average molecular weight as determined by gel permeation chromatography in the range of about 250 to about 10,000.

13. A composition in accordance with claim 8 wherein said ashless dispersant is a polyisobutenyl succinimide ashless dispersant formed from a polyisobutenyl succinic anhydride and triethylene tetramine in a mole ratio of about 1.8 moles of said anhydride per mole of triethylene tetramine, and wherein the polyisobutenyl group of said ashless dispersant is derived from polyisobutene having an average molecular weight in the range of about 750 to about 2500.

14. A composition in accordance with claim 8 wherein said borating agent is a boron acid.

15. A composition in accordance with claim 8 wherein said alkoxylated alcohol is an ethoxylated alcohol having average in the range of 1 to 3 ethoxy groups per molecule.

16. A composition in accordance with claim 8 wherein said phosphorous is phosphorous acid.

17. A composition in accordance with claim 8 wherein the ashless dispersant is a polyisobutenyl succinimide ashless dispersant formed from a polyisobutenyl succinic anhydride and triethylene tetramine in a mole ratio of about 1.8 moles of said anhydride per mole of triethylene tetramine, wherein the polyisobutenyl group of said ashless dispersant is derived from polyisobutene having an average molecular weight in the range of about 500 to about 5000, and wherein said alcohol is an ethoxylated alcohol having from 1 to 3 ethoxy groups per molecule, and wherein said borating agent is boric acid, and wherein said phosphorous is phosphorous acid.

18. A lubricating oil composition which comprises from 0.1 to 99.9 parts by weight of a composition of claim 1 and from 99.9 to 0.1 parts by weight of at least one oil of lubricating viscosity.

19. A lubricating oil composition which comprises from 0.1 to 50 parts by weight of a composition of claim 1 and from 50 to 0.1 parts by weight of at least one oil of lubricating viscosity.

20. A lubricating oil composition which comprises from 0.1 to 99.9 parts by weight of a composition of claim 8 and from 99.9 to 0.1 parts by weight of at least one oil of lubricating viscosity.

21. A lubricating oil composition which comprises from 0.1 to 99.9 parts by weight of a composition of claim 17 and from 99.9 to 0.1 parts by weight of at least one oil of lubricating viscosity.

22. A process to prepare a multifunctional gear additive composition which comprises heating concurrently or in any sequence a) an oil soluble ashless dispersant containing basic nitrogen selected from the group consisting of polybutenyl succinimide ashless dispersants with b) an alkoxylated alcohol selected from the group consisting of ethoxylated alcohols of 8 to 16 carbon atoms, c) a borating agent and d) an inorganic oxyacid or anhydride of phosphorous at a temperature of at least 100° C. for at least one hour and thereafter filtering and drying the composition.

* * * * *